United States Patent [19]

Weinberger

[11] Patent Number: 4,743,272

[45] Date of Patent: May 10, 1988

[54] GASOLINE SUBSTITUTE FUEL AND METHOD FOR USING THE SAME

[76] Inventor: Theodor Weinberger, 515 N. Church St., Charlotte, N.C. 28202

[21] Appl. No.: 918,027

[22] Filed: Oct. 14, 1986

Related U.S. Application Data

[63] Continuation of Ser. No. 578,131, Feb. 8, 1984, abandoned.

[51] Int. Cl.[4] ..... C10L 1/18

[52] U.S. Cl. ..... 44/53; 44/77; 44/78

[58] Field of Search ..... 44/53, 77, 78

[56] References Cited

U.S. PATENT DOCUMENTS

| | | | |
|---|---|---|---|
| 2,117,610 | 5/1938 | Jean | 44/53 |
| 3,697,240 | 10/1972 | Hori et al. | 44/53 |
| 3,917,537 | 11/1975 | Elsden | 44/53 |
| 4,265,638 | 5/1981 | Burke | 44/77 |
| 4,332,594 | 6/1982 | Zimmerman | 44/53 |
| 4,371,377 | 2/1983 | Weinberger | 44/77 |
| 4,396,398 | 8/1983 | Knight | 44/77 |
| 4,413,150 | 11/1983 | Briggs | 44/77 |

*Primary Examiner*—Jacqueline V. Howard
*Attorney, Agent, or Firm*—William R. Hinds

[57] ABSTRACT

Gasoline fuel substitutes are usable in existing gasoline powered engines. The fuel substitutes comprise a major amount of specified anhydrous alcohol mixtures containing methanol and/or ethanol and a minor amount of specified ketone/ether mixtures, and do not require any petroleum based components.

14 Claims, No Drawings

GASOLINE SUBSTITUTE FUEL AND METHOD FOR USING THE SAME

This is a continuation of application Ser. No. 578,131, filed Feb. 8, 1984, now abandoned.

FIELD OF THE INVENTION

This invention relates to novel fuel mixtures for use in internal combustion engines. More particularly, the invention relates to compositions for use as a gasoline substitute, most notably, in automobiles powered by internal combustion engines designed to be operated by gasoline.

BACKGROUND OF THE INVENTION

It is universally accepted that petroleum as a source of energy has a limited future. Nevertheless, very little progress has been made to find alternative sources of fuel to power internal combustion engines. The effort in the United States has focused primarily on finding ways to decrease rather than eliminate petroleum as the fuel source. In the United States this has boiled down to the use of diesel fuel, propane and "gasohol"—a blend of gasoline and about 10% grain derived ethanol. Although each has certain advantages, because all are petroleum based these approaches obviously beg the basic question of a viable alternative to limited petroleum reserves.

As a practical matter, the only near term commercially feasible alternative sources of fuel for the internal combustion engine are coal and biomass, principally grains. Conversion of coal to methanol and the conversion of biomass to ethanol for use as fuels are well-known. However, neither straight methanol nor straight ethanol can be used as gasoline substitutes without significant modifications to the engine.

Only Brazil has made a national commitment to use straight ethanol from indigenous biomass as an alternate source of fuel for its automobiles and other vehicles. Thus far, the Brazilian effort has failed. One reason is the unanticipated problems encountered in conversion and operation of vehicles powered with straight ethanol.

As far as is known, there has been no significant commitment made to methanol conversion, probably because of the economic limititations flowing from the inherently poor combustion properties of this fuel in comparison to gasoline, for example, see U.S. Pat. Nos. 4,298,351 and 4,386,938 to Earle. These patents disclose.compositions for use as a gasoline substitute wherein the compositions include methanol and peroxides. This mixture is alleged to increase the efficiency over straight methanol to give approximately the same miles per gallon as gasoline. However, this fuel composition suffers from combustion characteristics which produce auto-ignition and accompanying knocking in a conventional gasoline engine. As discussed above, the design of the engine can be changed to overcome these problems. However, to overcome these problems in existing engines, other additives, e.g. water and isopropanol are required. For example, see U.S. Pat. No. 4,298,351, column 2, lines 57–64, and U.S. Pat. No. 4,386,938, column 3, lines 6–12.

U.S. Pat. NO. 4,265,638 to Burke is exemplary of another synthetic fuel formulation which is alleged to be suitable for use as a substitute for gasoline in existing internal combustion engines. The major component of Burke's synthetic fuel is indeed an aliphatic hydrocarbon alcohol containing from two to eleven carbon atoms, isopropyl alcohol being preferred and disclosed in the example. Although this fuel composition contains no gasoline, it does contain a significant amount of a petroleum derived aromatic hydrocarbon, such as xylene. Thus, unlike Earle, the Burke formulation is not totally free of dependence on a petroleum source for all of its components. In addition, Burke, like Earle, requires the presence of water in the fuel formulation. Water is alleged to be a beneficial component in the formulations of Earle and Burke, but it is believed that water is an undesirable element in a fuel for gasoline powered internal combustion engines.

OBJECTS OF THE INVENTION

It is an object of this invention to provide a synthetic fuel formulation which is suitable for use in existing gasoline powered internal combustion engines. The synthetic fuel compositions of this invention do not contain added water and do not require the presence of an aromatic or aliphatic hydrocarbon component. (The term "hydrocarbon component" as used herein is meant to specify compounds which contain carbon and hydrogen atoms only. Such compounds are today almost exclusively derived from petroleum.) Indeed, it is believed that all ingredients of the fuel compositions of this invention can be derived economically from biomass sources using currently available technology. It is another object of this invention to provide a process for the preparation of the synthetic fuel compositions of this invention. A still further object is to provide a method of powering an internal combustion engine with the synthetic fuels of this invention.

SUMMARY OF THE INVENTION

These and other objects of this invention are accomplished by providing a gasoline fuel substitute which comprises a major amount of an alcohol mixture, wherein methanol and/or ethanol constitute a major component, and a minor amount of a ketone/ether mixture. In its preferred embodiments, all components of the synthetic fuels of this invention are derivable from biomass sources, principally grains.

Especially preferred is an anhydrous, hydrocarbon component-free gasoline fuel substitute consisting essentially of, based on the total volume of the fuel, about forty to about fifty volume percent ethanol, about seventeen to about twenty volume percent acetone, about thirteen to about seventeen volume percent methyl-tertiary-butyl ether, about ten to about thirteen volume percent 2-propanol and from about five to about ten volume percent of 1,2,3-propanetriol. Use of this composition can increase the mileage per gallon by up to about thirty percent over gasoline.

Another embodiment of this invention is a method for fueling an internal combustion engine which comprises feeding to said engine under combustion conditions the fuels of this invention. In its preferred embodiments the compositions of this invention are suitable for use in gasoline powered internal combustion engines.

A number of advantages flow from the use of the fuel admixtures described in the present invention. Of particular note is the ease with which the engine starts in cold weather. In addition the fuel mixtures of the present invention burn cleaner and exhibit less carbon deposits than current gasohol or gasoline fuels.

Insofar as the preparation of the fuel compositions of this invention is concerned, there is no criticality in the mode by which the ingredients are blended. In practice it has been found convenient to first add the major component, e.g. methanol and/or ethanol, of the alcohol mixture followed by the ketone and then the ether components. Finally the other components of the alcohol mixture, such as glycerol (1,2,3-propanetriol) and optionally 2-propanol, are added.

The components of the fuel compositions of this invention are generally blended in their anhydrous form. The fuel mixtures of this invention are preferably anhydrous. In removing water from the components of the fuel mixtures of this invention, it is preferred to employ a conventional desiccant for this purpose. Phosphorus pentoxide ($P_2O_5$) and dry ice are especially preferred desiccants. Other commercially available and cheap desiccants, such as corn starch, can be utilized. It will be recognized that although the components of the fuel mixtures of this invention are blended in their anhydrous form, some of these ingredients, as for example ethanol, absorb water rapidly from air, and therefore the fuel mixtures of this invention may contain some water at the time of combustion.

The alcohol components of the alcohol mixtures utilized herein can in general be any alcohol suitable for combustion in a gasoline engine, preferably those which can be economically obtained from biomass sources. The alcohols of this invention have the general formula $R(OH)_n$ wherein R is an alkyl of 1–4 carbon atoms or an aryl of 6–12 carbon atoms and wherein either or both of said alkyl and said aryl may be substituted with a moiety selected from hydroxy, an alkoxy of 1–4 carbon atoms, an alkyl ether of 1–4 carbon atoms, an aryl ether of 6–12 carbon atoms, an aryl of 6–12 carbons, or an alkenyl of 1–4 carbon atoms; n is an integer from 1–4, but not greater than the number of carbon atoms in R. All alcohol mixtures of this invention contain methanol or ethanol in a major amount. Exemplary of the alcohols which can be employed in the alcohol mixtures of this invention are methanol, ethanol, 1-propanol, 2-propanol, 1,2-propanediol (propylene glycol), 1,3-propanediol (trimethylene glycol), 1,2,3-propanetriol (glycerol), 1-butanol (n-buytyl alcohol), 2-butanol (sec-buytyl alcohol), 2-methyl-2-propanol (tert-butyl alcohol). The lower-alkyl (i.e. $C_{1-4}$), straight or branched chain alcohols are especially preferred. However, aromatic alcohols can be employed, and those containing 6–12 carbon atoms, as for example, phenol or biphenol, are preferred.

As discussed hereinabove, the alcohol mixtures of this invention always contain a major amount of methanol and/or ethanol. At least one of these alcohols is present in the alcohol mixtures in an amount ranging from about fifty to about seventy-five volume percent, based on the volume of the alcohol mixture. From about sixty-three to about seventy-seven volume percent has been found to be an especially preferred range.

The fuels of this invention contain a minor amount of a ketone/ether mixture. In the preferred embodiments, the ketone/ether mixtures constitute from about thirty volume percent to about forty volume percent of the total volume of the fuel composition. Within the ketone/ether mixture, the ketone is generally present in a major amount, usually falling within the range of about forty to about sixty volume percent of the total volume of the ketone/ether mixture. It is preferred that the ketone range from about fifty-four to about fifty-seven volume percent of the total ketone/ether mixture.

The ketone/ether mixtures of this invention can have more than one ketone or methanone ether component, the only requirement being that such mixtures have at least one ketone component and at least one ether component. Obviously, these components must be suitable for combustion in a gasoline engine.

The ketones of this invention have the general formula,

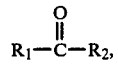

$$R_1-\overset{\overset{\displaystyle O}{\|}}{C}-R_2,$$

wherein $R_1$ and $R_2$, which may be the same or different, are each an alkyl of 1–6 carbon atoms, or an aryl of 6–12 carbon atoms, and each of which may be substituted with a moiety selected from hydroxy, an alkoxy or hydroxylated alkoxy of 1–4 carbon atoms, an alkyl ether of 1–4 carbon atoms, an aryl ether of 6–12 carbon atoms, or an alkenyl of 1–4 carbons.

Exemplary of the ketones which can be employed are acetone, methyl-isobutyl ketone, methyl ethyl ketone, diethyl ketone, ethyl amyl ketone, methyl hexyl ketone, dipropyl ketone, isopharone and the like.

The ether component, like the other components of the compositions of the compositions of this invention, must be suitable for combustion in a gasoline engine and have the general formula, $R_3—O—R_4$, wherein $R_3$ and $R_4$, which may be the same or different, are each an alkyl of 1–5 carbon atoms or aryl of 6–12 carbon atoms, and each of which may be substituted with a moiety selected from hydroxy, an alkoxy or hydroxylated alkoxy of 1–4 carbon atoms, an alkyl ether of 1–4 carbon atoms, an aryl ether of 6–12 carbon atoms, or an alkenyl of 1–4 carbons. Within the ketone/ether mixture the ether is generally present in a minor amount preferably falling within the volume percent range of between about forty-three to forty-six volume percent of the total ketone/ether mixture. Exemplary of such ethers are diethyl ether, di-n-propyl ether, di-n-pentyl ether, methyltertiary-butyl ether, ethyl-tertiary-butyl ether, dimethyl ether, monomethyl ether of triethylene glycol. The lower-alkyl-tertiary-butyl ethers such as methyl or ethyl tertiary-butyl ether are especially perferred ethers for use in the fuel compositions of this invention.

EXAMPLE 1

Gasoline fuel substitutes were prepared by thoroughly mixing the components together in the amounts (in liters) indicated in Table I. In these formulations all components containing water were dried with $P_2O_5$ prior to blending. Blending was performed in the following order: (1) ethanol, (2) ketone, (3) ether, (4) other alcohols.

TABLE I

| Formula Number | Ethyl Alcohol | Isopropyl Alcohol | Glycerol | Acetone | Methyl-t-butyl Ether |
|---|---|---|---|---|---|
| 1 | 1.90 l. | 0.38 l. | 0.19 l. | 0.76 l. | 0.57 l. |
| 2 | 1.90 l. | 0.38 l. | 0.38 l. | 0.65 l. | 0.49 l. |
| 3 | 1.52 l. | 0.49 l. | 0.38 l. | 0.76 l. | 0.65 l. |

EXAMPLE 2

The formulations of Example 1 were tested in a 1969 Chevrolet Chevelle equipped with a standard V-8 engine and carburetor. The tests were conducted under actual city and highway driving conditions. Fuel mileage figures were obtained by averaging the results of the tests. The gasoline substitute of Example 1 powered the vehicle effectively and gave about a thirty percent increase in mileage over that obtained using regular gasolines.

EXAMPLE 3

Formulations in all respects equivalent to those of Example 1 are prepared, except that no isopropyl alcohol is used and the amount of glycerol (volume % basis) is increased by the amount of isopropyl alcohol removed. The performance characteristics of these formulations are similar to those of Example 1.

While certain representative embodiments and details have been shown for the purpose of illustrating the present invention, it will be apparent to those skilled in the art that various changes and modifications may be made therein without departing from the spirit and scope of the invention. It will further be understood that the invention may comprise, consist essentially of or consist of the steps or materials recited herein.

I claim:

1. A gasoline fuel substitute comprising (i) greater than fifty volume percent of an anhydrous alcohol mixture wherein at least fifty volume percent of said mixture is methanol and/or ethanol and wherein the other alcohol components of said mixture are selected from an aliphatic or aromatic alcohol having up to about twelve carbon atoms and containing 1–4 hydroxy groups, and (ii) a minor amount, but at least about thirty volume percent, of a ketone/ether mixture having at least one ketone component and at least one ether component and wherein all components of said ketone/ether mixture are selected from the group consisting of ketones containing up to twelve carbon atoms and 1–2 keto oxygens and ethers containing up to twelve carbon atoms and 1–3 ether oxygens the fuel substitute being at least substantially anhydrous.

2. The fuel substitute composition of claim 1 wherein said alcohols are selected from alcohols having the general formula $R(OH)_n$ wherein R is an alkyl of 1–4 carbon atoms or aryl of 6–12 carbon atoms and wherein either or both of said alkyl or said aryl may be substituted with a moiety selected from hydroxy, an alkoxy of 1–4 carbon atoms, an alkyl ether of 1–4 carbon atoms, an aryl ether of 6–12 carbon atoms, an aryl of 6–12 carbons or an alkenyl of 1–4 carbon atoms, and n is an integer from 1–4, but not greater than the number of carbon atoms in R; said ketones are selected from the general formula $$R_1-\overset{\overset{\displaystyle O}{\|}}{C}-R_2$$

wherein $R_1$ and $R_2$, which may be the same or different, are each an alkyl of 1–6 carbon atoms, or an aryl of 6–12 carbon atoms, and each of which may be substituted with a moiety selected from hydroxy, an alkoxy or hydroxylated alkoxy of 1–4 carbon atoms, an alkyl ether of 1–4 carbon atoms, an aryl ether of 6–12 carbon atoms, or an alkenyl of 1–4 carbons; and said ethers have the general formula $R_3—0—R_4$ wherein $R_3$ and $R_4$, which may be the same or different, are each an alkyl of 1–5 carbon atoms or aryl of 6–12 carbon atoms, and each of which may be substituted with a moiety selected from hydroxy, an alkoxy or hydroxylated alkoxylated alkoxy of 1–4 carbon atoms, an alkyl ether of 1–4 carbon atoms, an aryl ether of 6–12 carbon atoms, or an alkenyl of 1–4 carbons.

3. The fuel of claim 1 wherein each said alcohol component of the alcohol mixture is an unsubstituted alkyl alcohol of 1–4 carbon atoms; said ketone and said ether are unsubstituted straight or branched chain alkyl ketones and ethers respectively of 1–6 carbons.

4. The composition of claim 1 and free of any hydrocarbon component.

5. The composition of claim 1 wherein said alcohols are selected from the group consisting of methanol ethanol, 1-propanol, 2-propanol, butyl alcohol, isobutyl alcohol, tertiary-butyl alcohol, and glycerol; wherein said ketone is selected from the group consisting of acetone, isophorone, methyl isobutyl ketone, methyl ethyl ketone, diethyl ketone, ethly amyl ketone, hexyl methyl ketone, dipropyl ketone and methyl methacrylate and wherein said ether is selected from the group consisting of methyl ether, ethyl ether, dipropyl ether, dipentyl ether, the monomethyl ether of triethylene glycol, methyl-t-butyl ether, ethyl-t-butyl ether, and triethylene glycol.

6. The composition of claim 1 wherein the alcohol mixture contains greater than fifty volume percent of ethanol and contains at least one alcohol selected from the group consisting of isopropyl alcohol and glycerol; said ketone is acetone and said ether is methyl-t-butyl ether.

7. A gasoline fuel substitute consisting essentially of, based of the total volume of said fuel, about forty to about fifty volume percent ethanol, about seventeen to about twenty volume percent acetone, about thirteen to about seventeen volume percent methyl-t-butyl ether, about ten to about thirteen volume percent isopropyl alcohol and from about five to about ten volume percent of glycerol.

8. The composition of claim 7 containing about forty percent ethanol, about thirteen percent isopropyl alcohol, about ten percent glycerol, about twenty percent acetone and about seventeen percent methyl-t-butyl ether.

9. The composition of claim 7 containing about fifty percent ethanol, about ten percent isopropyl alcohol, about ten percent glycerol, about seventeen percent acetone and about thirteen percent methyl-t-butyl ether.

10. The composition of claim 7 containing about fifty percent ethanol, about ten percent isopropyl alcohol, about five percent glycerol, about twenty percent acetone and about fifteen percent methyl-t-butyl ether.

11. A method of fueling an internal combustion engine which comprises feeding to said engine under combustion conditions the fuel of claim 1.

12. A method of fueling an internal combustion engine which comprises feeding to said engine under combustion conditions the fuel of claim 7.

13. A gasoline fuel substitute as claimed in claim 1 wherein said other alcohol components of the mixture comprise from about fifteen to about twenty-three volume percent of the fuel substitute, and substantially all of the volume apart from the alcohol mixture comprises the ketone/ether mixture, the ketone/ether mixture comprising greater than fifty volume percent ketone.

14. A gasoline fuel substitute as claimed in claim 1 consisting essentially of the anhydrous alcohol mixture and the ketone/ether mixture, and thus being substantially devoid of water and petroleum derivatives.

* * * * *